United States Patent [19]

Suga et al.

[11] Patent Number: 5,015,567

[45] Date of Patent: May 14, 1991

[54] METHOD FOR PRODUCING SILVER HALIDE PHOTOGRAPHIC EMULSION AND SILVER HALIDE PHOTOGRAPHIC MATERIAL

[75] Inventors: Shuzo Suga, Shizuoka; Tadao Shishido; Hiroyuki Mifune, both of Kanagawa; Yoshiro Kawashima, Shizuoka, all of Japan

[73] Assignee: Fuji Photo Film Co., Ltd., Kanagawa, Japan

[21] Appl. No.: 308,964

[22] Filed: Feb. 10, 1989

Related U.S. Application Data

[63] Continuation of Ser. No. 21,045, Mar. 2, 1987, abandoned, which is a continuation of Ser. No. 658,711, Oct. 9, 1984, abandoned.

[30] Foreign Application Priority Data

Oct. 7, 1983 [JP] Japan ..... 58-188226

[51] Int. Cl.[5] ..... G03C 1/09; G03C 1/34

[52] U.S. Cl. ..... 430/567; 430/569; 430/603; 430/605; 430/611; 430/615

[58] Field of Search ..... 430/603, 605, 611, 615, 430/567, 569, 599

[56] References Cited

U.S. PATENT DOCUMENTS

| | | | |
|---|---|---|---|
| 3,021,215 | 2/1962 | Williams et al. | 430/603 |
| 3,625,697 | 12/1971 | Sato et al. | 430/599 |
| 4,266,018 | 5/1981 | Ishiguro et al. | 430/611 |
| 4,276,374 | 6/1981 | Mitune et al. | 430/603 |
| 4,284,717 | 8/1981 | Toya et al. | 430/603 |
| 4,469,783 | 9/1984 | Kuwabara et al. | 430/567 |
| 4,469,784 | 9/1984 | Heki et al. | 430/567 |

FOREIGN PATENT DOCUMENTS

| | | | |
|---|---|---|---|
| 1315755 | 5/1973 | United Kingdom | 430/603 |

*Primary Examiner*—Charles L. Bowers, Jr.
*Assistant Examiner*—Lee C. Wright
*Attorney, Agent, or Firm*—Sughrue, Mion, Zinn Macpeak & Seas

[57] ABSTRACT

A silver halide photographic emulsion is subjected to sulfur or gold-sulfur sensitization in the presence of a combination of (1) at least one of an organic thioether compound or a tetrasubstituted thiourea and (2) a nitrogen-containing heterocyclic compound, to achieve the prevention of pressure desensitization and safelight aptitude deterioration.

19 Claims, No Drawings

METHOD FOR PRODUCING SILVER HALIDE PHOTOGRAPHIC EMULSION AND SILVER HALIDE PHOTOGRAPHIC MATERIAL

This is a continuation of application Ser. No. 07/021,045, filed Mar. 2, 1987 now abandoned which is a continuation of application Ser. No. 06/658,711 filed Oct. 9, 1984 now abandoned.

FIELD OF THE INVENTION

This invention relates to a silver halide photographic emulsion and a silver halide photographic material, and more particularly, to a method for producing a silver halide emulsion sensitized chemically by a sulfur compound or a combination of a gold compound and a sulfur compound.

BACKGROUND OF THE INVENTION

In the art of producing silver halide photographic emulsions, it is generally desired to achieve further improvements in the sensitivity of photographic emulsions. Chemical sensitization with a sulfur compound or combination of a gold compound and a sulfur compound has been prevailingly employed as a useful method for enhancing the sensitivity of a silver halide photographic emulsion.

In addition, it is universally known that when a silver halide photographic emulsion is chemically sensitized by both a gold compound and a sulfur compound, the inherent sensitivity of the photographic emulsion can be further increased by a combined use with a nitrogen-containing heterocyclic compound, such as a hydroxytetrazaindene compound or the like. Details thereof are described, e.g., in British Patent No. 1,315,755, etc.

However, when such a nitrogen-containing heterocyclic compound such as hydroxytetrazaindene or the like is added to a photographic emulsion upon chemical sensitization using both a gold compound and a sulfur compound, though the processing dependence (e.g., development temperature dependence, etc.) is greatly improved along with the enhancement of sensitivity, it creates problems in that pressure desensitization occurs to a significant extent in photographic films to which pressure has been applied before exposure, and deterioration of an aptitude for safelight (i.e , generation of fog by exposure to safelight) occurs.

The quality of images subject to impairment by, e.g., pressure desensitization, can be improved using known means. For instance, means are known so as to make it impossible for applied pressure to effectively reach the silver halide grains, e.g., a method of incorporating a plastisizer such as polymers, emulsions, etc., a method involving lowering the silver halide to gelatin ratio in the silver halide emulsion, and so on.

More specifically, there have been disclosed a method of using heterocyclic compounds in British Patent No. 738,618, a method of using alkyl phthalates in British Patent No. 738,637, a method of using alkyl esters in British Patent No. 738,639, a method of using polyhydric alcohols in U.S. Pat. No. 2,960,404, a method of using carboxyalkyl celluloses in U.S. Pat. No. 3,121,060, a method of using paraffin and carboxylates in Japanese Patent Application (OPI) No. 5017/74 (The term "OPI" as used herein refers to a "published unexamined Japanese patent application), a method of using alkylacrylates and organic acids in Japanese Patent Publication No. 28086/78, and so on.

However, the method of using plasticizer is restricted as to the amount of plasticizer used because the plasticizer lowers the mechanical strength of the emulsion layers. On the other hand, increasing the content of gelatin reduces the speed of development processing, and so on. Thus, both of these methods are difficult to use so as to fully achieve their desired effects in view of the foregoing defects, but furthermore they are also unable to achieve any improvement in the above-described deteriorated aptitude for safelight.

SUMMARY OF THE INVENTION

Therefore, a primary object of this invention is to provide a method for producing a silver halide photographic emulsion and a silver halide photographic material, in which pressure desensitization and deterioration of an aptitude for safelight are prevented, when enhancement of sensitivity and improvement in processing dependence are brought about by addition of a nitrogen-containing heterocyclic compound upon chemical sensitization using a gold compound or a sulfur compound, without being attended by impairment as noted above.

The above-described object of this invention is attained by subjecting a silver halide photographic emulsion to sulfur sensitization or gold-sulfur sensitization in the presence of (1) at least one of an organic thioether compound and a tetrasubstituted thiourea and (2) a nitrogen-containing heterocyclic compound.

That is, as a result of extensive investigation, it has now been found that combination with an organic thioether or a tetrasubstituted thiourea enables significant improvements in pressure desensitization and safelight aptitude, in addition to retaining the beneficial results obtained by using a nitrogen-containing heterocyclic compound upon chemical sensitization.

The above-described effects can be produced only when the organic thioether or the tetrasubstituted thiourea of this invention is used at the time of chemical sensitization, and they cannot be acquired by adding the compound of this invention to a silver halide emulsion, e.g., after production and just before coating of the emulsion.

DETAILED DESCRIPTION OF THE INVENTION

Tetrasubstituted thioureas which can be preferably used in this invention are represented by formula (I)

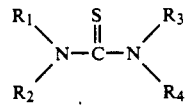

(I)

wherein $R_1$, $R_2$, $R_3$, and $R_4$, which may be the same or different from one another, each represents a substituted or unsubstituted alkyl group, an alkenyl group (such as allyl group, etc.), or a substituted or unsubstituted aryl group. The total number of carbon atoms contained therein is preferably 30 or less. In addition, $R_1$ and $R_2$, $R_2$ and $R_3$, or $R_3$ and $R_4$ can combine with each other to form a 5- or 6-membered heterocyclic ring (e.g., imidazolidinethione, piperidine, morpholine, etc.).

The above-described alkyl group includes both straight chain and branched ones. Suitable examples of substituents which the alkyl group may have include a hydroxy group (—OH), a carboxysulfonic acid group, an amino group, an alkoxy group (O-alkyl) whose alkyl moiety has 1 to 5 carbon atoms, a phenyl group and a 5- to 6-membered hetero ring (e.g., furan, etc.). Examples of substituents by which the aryl group may be substituted include a hydroxy group, a carboxy group, and a sulfonic acid group.

In particularly preferred tetrasubstituted thioureas, three or more of substituents $R_1$ to $R_4$ are alkyl groups, each of these alkyl groups has from 1 to 5 carbon atoms, the aryl group, if present, is a phenyl group, and the total number of carbon atoms contained in $R_1$ to $R_4$ is 20 or less.

Specific examples of these tetrasubstituted Thioureas are illustrated below.

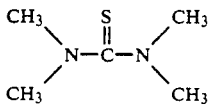
I-1

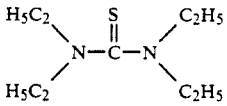
I-2

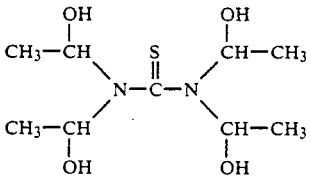
I-3

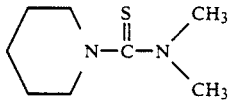
I-4

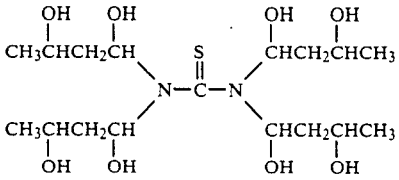
I-5

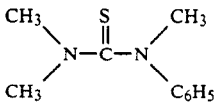
I-6

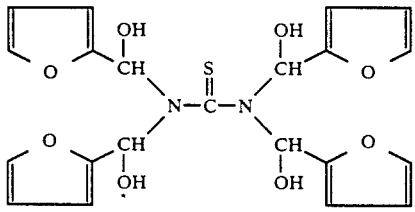
I-7

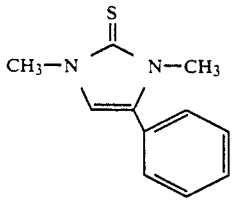
I-8

-continued

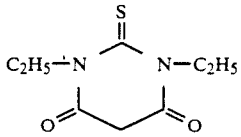
I-9

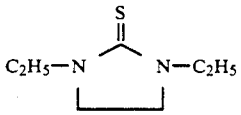
I-10

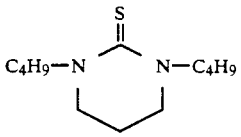
I-11

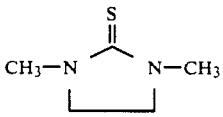
I-12

The compounds illustrated above can be prepared using methods described, e.g., in J. Braun & K. Weissbach, *Berichte der Deutschen Chemischen Gesellschaft*, vol. 63, p. 2846 (1930), V. Mozolis & S. Jokubaityte, *Lietuvos T S R Mokslu Akademijos Darbai*, Ser. B 1969 [3], 125-31, H. Weidinger & H. Eilingsfeid, German Patent No. 1,119,843, R.A. Donia et al., *Journal of Organic Chemistry*, Vol. 14, pp. 946-951 (1949), F.B. Zienty, *Journal of American Chemical Society*, Vol. 68, pp. 1388-1389 (1946), L.G.S. Brooker et al., *Journal of American Chemical Society*, Vol. 73, pp. 5329-5332 (1951), and so on.

A suitable amount of the tetrasubstituted thiourea to be employed upon chemical sensitization in the present invention generally ranges from 1 mg to 10 g, and preferably from 1 mg to 1 g, per mole of silver halide present in the silver halide emulsion.

Organic thioether compounds which are preferably used in the present invention include those having an ether linkage or a peptide linkage in the molecule, cyclized thioether, and those having certain substituents. Preferred organic thioether compounds are represented by formulae (II), (III), and (IV).

$$R_1—(X\text{-}R_3)_m—X—R_2 \quad \text{(II)}$$

wherein $R_1$ and $R_2$ each represents a substituted alkyl group containing from 1 to 5 carbon atoms, which may have two or more of substituents, such as —OH, —$NHR_4$, —$COOR_4$, —$CONH_2$, —$SO_3H$, —COOM and —$SO_3M$; $R_3$ represents an alkylene group containing from 1 to 4 carbon atoms, which may be substituted by a hydroxy group (—OH); $R_4$ represents a hydrogen atom, or an alkyl group containing from 1 to 5 carbon atoms; X represents a sulfur atom or an oxygen atom, and at least one X within —$(X—R_3)_m$—must be a sulfur atom; m represents O or an integer of 1 to 4; and M represents an alkali metal atom; and $$Q—[(CH_2)_r—CH_2—S—(CH_2)_2—X—(R)_p—(CH_2)_2—(R')_q—S13\ CH_2(CH_2)_m—Z]_n \quad \text{(III)}$$

$$Q—(CH_2)_m—CH_2—S—(CH_2)_n—S—CH_2—(CH_2)_r—Z \quad \text{(IV)}$$

wherein r and m each represents O or an integer of from 1 to 4; n represents an integer of 1 to 4; p and q each represents 0 or an integer of 1 to 3; X represents an oxygen atom, a sulfur atom, $$-\overset{O}{\overset{\|}{C}}NH-,\ -\overset{O}{\overset{\|}{C}}-\ \text{or}\ -\overset{O}{\overset{\|}{C}}-O-;$$

R and R′ each represents an ethylene oxide group; and Q and Z each represents —OR″, $$-\overset{O}{\overset{\|}{C}}-OR''$$

(wherein R″ represents a hydrogen atom or an alkyl group containing from 1 to 5 carbon atoms), $$-\overset{O}{\overset{\|}{C}}NH_2,$$

or Q and Z can represent substituents set forth as X and combine with each other to form a cyclized compound.

More desirable compounds among those represented by formula (III) or (IV) are represented by formulae (A) to (F)

$$HO-R^2-(S-R^4)_n-S-R^2-OH \quad (A)$$

$$(HO-R^2-S-R^2-O-R^4-)_2 \quad (B)$$

$$(R^3-O-R^2-S-R^2-\overset{O}{\overset{\|}{C}}-NH-R^4-)_2 \quad (C)$$

$$(R^2-O-R^2-S-R^2-)_2S \quad (D)$$

$$(R^3-NH-\overset{O}{\overset{\|}{C}}-R^2-S-R^2-)_2O \quad (E)$$

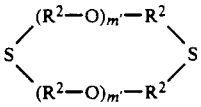

(F)

wherein r′ is O or an integer of 1 to 3, m′ is 1 or 2, $R^2$ and $R^4$ each is a methylene group or an alkylene group containing from 1 to 5 carbon atoms, such as ethylene, and $R^3$ is an alkyl group containing from 1 to 5 carbon atoms, such as ethyl.

Specific examples of the organic thioether compounds of the present invention are illustrated below.

II - 1

$$HO(CH_2)_2-S-(CH_2)_2-S-(CH_2)_2OH$$

II - 2

$$HO(CH_2)_3-S-(CH_2)_2-S-(CH_2)_3OH$$

II - 3

$$HO(CH_2)_2-S-(CH_2)_2-S-(CH_2)_2-S-(CH_2)_2OH$$

II - 4

$$[HO-(CH_2)_2-S-(CH_2)_2-O-CH_2-]_2$$

II - 5

$$[HO-(CH_2)_5-S-(CH_2)_5-O-(CH_2)_2-]_2$$

II - 6

$$[H_5C_2-O-(CH_2)_2-S-(CH_2)_2-]_2S$$

II - 7

$$[H_3C-O-(CH_2)_4-S-(CH_2)_4-]_2S$$

II - 8

$$[H_3C-NH-\overset{O}{\overset{\|}{C}}-(CH_2)_2-S-(CH_2)_2-]_2O$$

II - 9

$$[H_5C_2-NH-\overset{O}{\overset{\|}{C}}-(CH_2)_3-S-(CH_2)_3-]_2O$$

II - 10

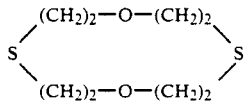

II - 11

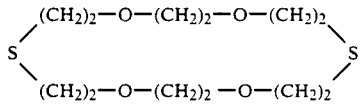

II - 12

$$[NH_2CO(CH_2)_2-S-(CH_2)_2CONH-CH_2-]_2$$

II - 13

$$HOOC-CH_2-S-(CH_2)_2-S-CH_2COOH$$

II - 14

$$HOCH_2\underset{\underset{OH}{|}}{C}HCH_2-S-CH_2CH_2-S-CH_2CH_2-S-CH_2\underset{\underset{OH}{|}}{C}HCH_2OH$$

II - 15

$$[H_3C-O-(CH_2)_2-S-(CH_2)_2-\overset{O}{\overset{\|}{C}}-NH-CH_2]_2-S$$

II - 16

$$HOOCCH_2\underset{\underset{OH}{|}}{C}HCH_2-S-CH_2CH_2-S-CH_2\underset{\underset{OH}{|}}{C}HCH_2COOH$$

II - 17

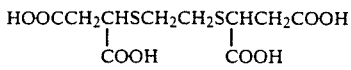

II - 18

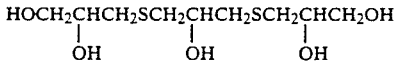

II - 19

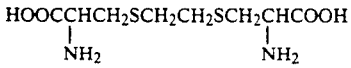

II - 20

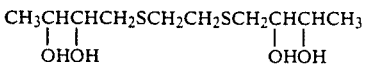

II - 21

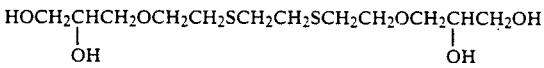

II - 22

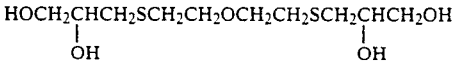

II - 23

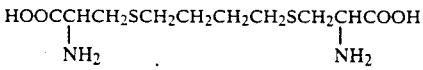

These organic thioether compounds which can be employed in the present invention are not particularly restricted as to the synthesis method thereof, and can be synthesized according to generally known methods.

For example, such methods are described in British Patent No. 950,089, U.S. Pat. No. 3,021,215, *Journal of Organic Chemistry*, vol. 26, pp. 1991–1995 (1961), etc.

A suitable amount of the organic thioether compound to be used upon chemical sensitization in the present invention generally ranges from 1 mg to 10 g, and preferably from 1 mg to 1 g, per 1 mole of silver halide in the silver halide photographic emulsion.

As examples of heterocyclic rings of nitrogen-containing heterocyclic compounds which can be employed in the present invention, mention may be made of a pyrazole ring, a pyrimidine ring, a triazole ring, a thiadiazole ring, a tetrazole ring, a pyridazine ring, a triazine ring, a triazolotriazole ring, a diazaindene ring, a triazaindene ring, a tetraazaindene ring., a pentaazaindene ring, a benzimidazole ring, an indazole ring, a benzothiazole ring and so on. Further, these rings may have various kinds of substituent groups. For example, they may be substituted by a hydroxyl group, an alkyl group, an amino group, an alkylthio group, a halogen atom, a cyano group, a substituted alkyl group, a substituted amino group (e.g., hydroxyamino, alkylamino, dialkylamino, arylamino, etc.) or so on. Of these substituent groups, a hydroxyl group is the most desirable one.

Preferred nitrogen-containing heterocyclic compounds are those having an azaindene ring. In particular, hydroxytriazaindene, hydroxytetraazaindene, hydroxypentaazaindene and the like can be used with advantage.

The compounds preferred over others in the class of azaindenes are represented by formula (V) or (VI)

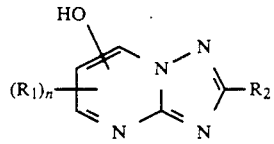

(V)

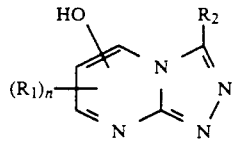

(VI)

wherein $R_1$ and $R_2$, which may be the same or different, each represents a hydrogen atom; an aliphatic residue, such as an alkyl group (e.g., methyl, ethyl, propyl, pentyl, hexyl, octyl, isopropyl, sec-butyl, t-butyl, cyclohexyl, cyclopentylmethyl, 2-norbornyl, etc.), an alkyl group substituted by an aromatic residue (e.g., benzyl, phenetyl, benzhydryl, 1-naphthylmethyl, 3-phenylbutyl, etc.), an alkyl group substituted by an alkoxy group (e.g., methoxymethyl, 2-methoxyethyl, 3-ethoxypropyl, 4-methoxybutyl, etc.), an alkyl group substituted by a hydroxy group, a carbonyl group or an alkoxycarbonyl group (e.g., hydroxymethyl, 2-hydroxymethyl, 3-hydroxybutyl, carboxymethyl, 2-carboxyethyl, 2-(methoxycarbonyl)ethyl, etc.), etc.; or an aromatic residue, such as an aryl group (e.g., phenyl, 1-naphthyl, etc.), an aryl group having a substituent group (e.g., p-tolyl, m-ethylphenyl, m-cumenyl, mesityl, 2,3-xylyl, p-chlorophenyl, o-bromophenyl, p-hydroxyphenyl, 1-hydroxy-2-naphthyl, m-methoxyphenyl, p-ethoxyphenyl, p-carboxyphenyl, o-(methoxycarbonyl)phenyl, m-(ethoxycarbonyl)phenyl, 4-carboxy-1-naphthyl, etc.), etc.; and n represents 1 or 2.

Specific examples of nitrogen-containing heterocyclic compounds which can be employed in the present invention are described below.

V - 1. 4-Hydroxy-6-methyl-1,3,3a,7-tetraazaindene

V - 2. 5-Carboxy-4-hydroxy-1,3,3a,7-tetraazaindene

V - 3. 4-Hydroxy-5-n-octyl-6-methyl-1,3,3a,7-tetraazaindene

V - 4. 1,2-Bis(4-hydroxy-6-methyl-1,3,3a,7-tetraazaindene-5-yl)ethane

V - 5. 1,2,3,4-Tetrakis(4-hydroxy-6-methyl-1,3,3a,7tetraazaindene-2-yl)butane

V - 6. 2-Amino-5-carboxy-4-hydroxy-1,3,3a,7-tetraazaindene

V - 7. 4-Hydroxy-2-β-hydroxyethyl-6-methyl-1,3,3a,7-tetraazaindene

V - 8. 5-Carbethoxy-4-hydroxyethyl-1,3,3a,7-tetraazaindene

V - 9. 7-Hydroxy-1,2,3,4,6-pentaazaindene

V - 10. 4-Hydroxy-2-γ-hydroxypropyl-6-methyl-1,3,3a,7-tetraazaindene

V - 11. 4-Hydroxy-2(4-pyridyl)-6-methyl-1,3,3a,7-tetraazaindene

V - 12. 2-Carboxy-4-hydroxy-6-methyl-1,3,3a,7-tetraazaindene

V - 13. 4-Hydroxy-6-ethyl-1,3,3a,7-tetraazaindene

7 - 14. 4-Hydroxy-5-ethyl-6-methyl-1,3,3a,7-tetraazaindene
7 - 15. 2,4-Dihydroxy-6-methyl-1,3a,7-triazaindene
V - 16. 2-Methyl-4-hydroxy-6-methyl-3,3a,7-triazaindene
V - 17. 5-Bromo-4-hydroxy-6-methyl-1,3,3a,7-tetraazaindene
V - 18. 1,2-Bis(4-hydroxy-6-methyl-1,3,3a,7-tetraazaindene-2-yl)-1,2-dihydroxyethane
V - 19. 1,6-Bis(4-hydroxy-6-methyl-1,3,3a,7-tetrazaindene-2-yl)-2,5-dioxahexane
V - 20. 1,4-Bis(4-hydroxy-6-methyl-1,3,3a,7-tetrazaindene-2-yl)-butane
V - 21. 5-Amino-7-hydroxy-2-phenyl-1,2,3,4,6-pentaazaindene
V - 22. 5-Amino-2-p-carboxyphenyl-7-hydroxy-1,2,3,4,6-pentaazaindene
V - 23. 2-p-Aminophenyl-5-amino-7-hydroxy-1,2,3,4,6-pentaazaindene
V - 24. 5-Amino-7-hydroxy-2-p-methoxyphenyl-1,2,3,4,6-pentaazaindene
V - 25. 5-Dimethylamino-7-hydroxy-2-phenyl-1,2,3,4,6-pentaazaindene
V - 26. 5,7-Dihydroxy-1,2,3,4,6-pentaazaindene
V - 27. 5-Hydroxy-1,2,3,4,6-pentaazaindene
V - 28. 5-Hydroxy-7-methyl-1,2,3,4,6-pentaazaindene
V - 29. 2,4-Dihydroxy-6-methyl-1,3a,7-triazaindene
V - 30. 4-Hyd.roxy-5-chloro-1,3,3a,7-tetraazaindene A suitable addition amount of the nitrogen-containing heterocyclic compounds which can be employed in the present invention can be varied over a wide range depending upon the grain size of silver halide used, the halogen composition of silver halide used and the condition of chemical sensitization. In general, it ranges from 1 mg to $1\times10^4$ mg, and preferably from 1 mg to $1\times10^3$ mg, per 1 mole of silver halide.

In the sulfur sensitization of the present invention, sulfur sensitizers, that is, active gelatin and compounds containing sulfur capable of reacting with silver ion, such as thiosulfates, allylthiocarbamide, thiourea, allylisothiacyanate, cystine, salts of p-toluenesulfonic acid, rhodanine, mercapto compounds, and the like can be employed. In addition, compounds as described in U.S. Pat. Nos. 1,574,944, 2,410,689, 2,278,947, 2,728,668, 3,656,955, and so on can also be employed.

A suitable amount of these sulfur sensitizers added, though can be varied over a considerably wide range under various conditions, ranges generally from about $10^{-7}$ mole to about $10^{-2}$ mole per 1 mole of silver.

With respect to gold sensitization according to the present invention, an oxidation number of gold in gold sensitizers to be used may be either plus univalent or plus trivalent. Specific examples of gold sensitizers which can be employed include chloroaurates, potassium chloroaurate, auric trichloride, potassium auric thiocyanate, potassium iodoaurate, tetracyanoauric acid, and the like.

A suitable amount of these gold sensitizers added, though can be varied over a considerably wide range under various conditions, generally ranges from about $10^{-9}$ mole to $10^{-2}$ mole per 1 mole of silver.

On the other hand, in the gold-sulfur sensitization, a ratio between both sensitizers used is changed depending on the ripening condition and so on. In general, a sulfur sensitizer is used in an amount of from about 1 mole to about 1,000 mole per 1 mole of a gold sensitizer. A gold sensitizer may be added simultaneously with the addition of a sulfur sensitizer, in the course of sulfur sensitization, or after the conclusion of sulfur sensitization.

In the present invention, these sensitizers are added to a silver halide photographic emulsion in a conventional manner. Specifically, compounds soluble in water are added in a form of water solution, and compounds soluble in organic solvents are added in a form of solution in a water miscible organic solvent such as methanol, ethanol or the like.

In addition, the chemical sensitization of the present invention is not particularly restricted as to pH, pAg, temperature and other conditions. However, it is preferable to adjust the pH value to within a range of from 4 to 9, and more preferably from 5 to 8, to keep the pAg value at from 5 to 11, and more preferably from 8 to 10, and to control the temperature within a range of from 40 to 90° C., and more preferably from 45 to 75° C.

Photographic emulsions which can be employed in the present invention can be prepared using methods described in P. Glafkides, *Chimie et Physique Photographique,* Paul Montel, Paris (1967); G.F. Duffin, *Photographic Emulsion Chemistry,* The Focal Press, London (1966); V.L. Zelikman et al., *Making and Coating Photographic Emulsion,* The Focal Press, London (1964), and so on. Any of methods including the acid process, the neutral process, and the ammonia process can be employed. Suitable methods for reacting a water-soluble silver salt with a water-soluble halide include, e.g., a single jet method, a double jet method, or a combination thereof.

Also, a method in which silver halide grains are produced in the presence of excess silver ion (the so-called reverse mixing method) can be employed in the present invention. On the other hand, the so-called controlled double jet method, in which the pAg of the liquid phase in which silver halide grains are to be precipitated is maintained constant, may be also employed herein.

In a process for producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

Silver halides which may be present in the silver halide emulsions of the present invention include silver bromide, silver iodobromide, silver iodochlorobromide, and silver chlorobromide.

Preferred silver halides are silver iodobromide and silver iodochlorobromide in which the silver iodide content is 10 mole% or less. Particularly preferably, the silver iodide content therein is 5 mole% or less. A preferred silver chloride content in silver iodochlorobromide is 10 mole% or less.

Further, the silver iodide distribution in the silver halide grains is preferably homogeneous throughout the grains or the silver iodide content is preferably higher in the internal portion than in the surface portion of the silver halide grains.

By the terminology "the silver iodide distribution in the silver halide grains is homogeneous" as used herein is meant that when the silver halide grains are divided into fine portions (e.g., divided in fine portions of equal volume throughout the center to the surface thereof), the silver iodide content of any fine portion is approximately the same as the mean silver iodide content of the whole silver halide grains, and particularly is within 10%, and preferably is within 5%, of the mean silver iodide content of the whole silver halide grains.

By the terminology "the silver halide grains in which the silver iodide content is higher in the internal portion than in the surface portion thereof" is meant that when the silver halide grains are divided, for example, into a central portion and the surface portion having a 1/1 volume ratio, silver iodide exists in the central portion at a content from above 50% to 100%, preferably from above 50% to 95%, and more preferably from above 50% to 75% and in the surface portion at a content of from 0% to less than 50%, preferably from 5% to less than 50%, and more preferably from 25% to less than 50%.

An internal distribution of silver iodide in silver halide grains of the present invention can be determined using a combined method of ion etching and X-ray photoelectron spectroscopy (XPS) reported by, e.g., T.M. Kelly & M.G. Mason with the title "Profile of Halogen Composition in Silver Halide Fine Grains" in *Journal of Applied Physics,* vol. 47 (11), p. 4721 (1976).

The silver halide grains of the present invention may be employed as a part of silver halide grains to be employed for the desired photographic emulsion layer. They are preferably employed in a proportion of 20% or more, and more preferably 50 wt% or more, of the total silver halide grains.

The grains of the present invention, whose distribution density of silver iodide is homogeneous throughout, or higher at the interior of the grains than at the surface thereof can be prepared using known various methods.

Photographic emulsions of the present invention are chemically sensitized. Chemical sensitization can be carried out using processes described in, e.g., H. Frieser, *Die Grühdlagen der Photographischen Prozesse mit Silverhalogeniden,* pp. 675–734, Akademische Verlagsgesellschaft (1968).

In addition to the above-described sulfur sensitization and gold-sulfur sensitization, a reduction sensitization process using a reducing compound (e.g., stannous salts, amines, hydrazine derivatives, formamidine sulfinic acid, silane compounds, etc.), a noble metal sensitization process using a noble metal compound (e.g., Group VIII metal complexes such as those of platinum, iridium, palladium, etc., other than gold metal complexes) and so on can be employed in combination for the purpose of chemically sensitizing the photographic emulsions of the present invention.

Reduction sensitization processes are described in U.S. Pat. Nos. 2,983,609, 2,419,974, 4,054,458 and so on, and noble metal sensitization processes are described in U.S. Pat. Nos. 2,399,083 and 2,448,060, British Patent No. 618,061, and so on.

The photographic material of the present invention can contain a wide variety of compounds for purpose of preventing fogging or stabilizing photographic functions during production, storage, or processing. More specifically, a variety of compounds known as antifoggants or stabilizers, such as azoles, e.g., benzothiazolium salts, nitroindazoles, triazoles, benzotriazoles, benzimidazoles (particularly nitro- or halogen-substituted benzimidazoles), etc.; heterocyclic mercapto compounds, e.g., mercaptothiazoles, mercaptobenzothiazoles, mercaptobenzimidazoles, mercaptothiadiazoles, mercaptotetrazoles (particularly 1-phenyl-5-mercaptotetrazole), mercaptopyrimidines, etc.; the above-described heterocyclic mercapto compounds having a water soluble group, such as carboxylic group, sulfonic group, or the like; thioketo compounds like oxazolinethione; azaindenes, e.g., tetraazaindenes (particularly 1,3,3a,7-tetraazaindenes substituted by a hydroxy group at the 4-position); benzenethiosulfonic acids; benzenesulfinic acid; and so on can be added to the photographic materials. Further details of specific examples of these compounds and usages thereof are described, e.g., in U.S. Pat. Nos. 3,954,474, 3,982,947 and 4,021,248, and Japanese Patent Publication No. 28660/77

The photographic material of the present invention can contain a dispersion of a water-insoluble or slightly soluble synthetic polymer in its photographic emulsion layers or other hydrophilic colloidal layers for purposes of improving dimensional stability of such layers, and so on. For example, polymers containing as a monomer unit an alkyl(metha)acrylate, an alkoxyalkyl(metha)acrylate, a glycidyl(metha)acrylate, a (metha)acrylamide, a vinyl ester (e.g., vinyl acetate), acrylonitrile, an olefin, styrene and the like individually or in combination of two or more thereof, or a combination of one or more of the above-described monomers with one or more of a monomer selected from a group comprising acrylic acid, methacrylic acid, $\alpha,\beta$-unsaturated dicarboxylic acids, hydroxyalkyl(metha)acrylates, sulfoalkyl(metha)acrylates, styrenesulfonic acids, and so on can be used. More specifically, those described in U.S. Pat. Nos. 2,376,005, 2,739,137, 2,853,457, 3,062,674, 3,411,911, 3,488,708, 3,607,290, 3,635,715, 3,645,740 and 3,525,620, and British Patent Nos. 1,186,699 and 1,307,373 can be employed for the above-described purpose.

The photographic emulsions of the present invention may be spectrally sensitized using methine dyes or other dyes. Suitable spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring, with specific examples including indolenine, benzindolenine, indole, benzoxazole, naphthoxazole, benzothiazole, naphthothiazole, benzoselenazole, benzimidazole, quinoline and like nuclei. Each of these nuclei may have some substituent group on its constituent carbon atoms.

The merocyanine and complex merocyanine dyes can contain 5- or 6-membered heterocyclic nuclei, such as pyrazoline-5-one, thiohydantoin, 2-thioxazolidine-2,4-dione, thiazoline-2,4-dione, rhodanine, thiobarbituric acid and like nuclei, as ketomethylene structure-containing nuclei.

The photographic emulsion layers of the photographic material of the present invention may contain, for example, polyalkylene oxides and derivatives such as the ethers, esters and amines thereof, thioether compounds, thiomorpholines, quaternary ammonium salt compounds, urethane derivatives, urea derivatives, imidazole derivatives, 3-pyrazolidones and so on in order to increase the sensitivity and contrast thereof, or in order to accelerate the developing rate thereof. Examples of such compounds are described, for instance, in U.S. Pat. Nos. 2,400,532, 2,423,549, 2,716,062, 3,617,280, 3,772,021 and 3,808,003, British Patent No. 1,488,991, and so on.

As for the binder or protective colloid of the photographic emulsion, gelatins (e.g., lime-processed gelatin, acid-processed gelatin, gelatin derivatives, gelatin-grafted polymers, etc.) can be used to advantage. Of course, hydrophilic colloids other than gelatins (e.g., hydroxyethyl cellulose, polyvinyl alcohol, polyvinylimidazole, etc.) can also be used.

The photographic emulsion layers and other hydrophilic colloidal layers of the photographic material of the present invention may contain various kinds of surface active agents as a coating aid, and for other purposes, for example, prevention from the generation of static charges, improvements in slippability, emulsifying dispersion, prevention from the generation of adhesion, improvements in the photographic characteristics (e.g., development acceleration, increase in contrast, sensitization and so on) and so on.

Examples of suitable surface active agents which can be used include saponin (steroid type); nonionic surface active agents of the alkyleneoxide type (e.g., polyethylene glycol, polyethylene glycol/polypropylene glycol condensates, polyethylene glycol alkyl or alkyl aryl ethers, ethers, polyethylene glycol, polyethylene glycol esters, polyethylene glycol sorbitane esters, polyalkylene glycol alkyl amines or amides, polyethylene oxide adducts of silicone, etc.) and the glycidol type (e.g., alkenylsuccinic acid polyglycerides, alkylphenol polyglycerides, etc.), fatty acid esters of polyhydric alcohols, alkyl esters of sugar, and so on; anionic surface active agents containing acid groups such as a carboxylic acid group, a sulfonic acid group, a phosphoric acid group, a sulfate group, a phosphate group, etc., such as alkylcarboxylates, alkylsulfonates, alkylbenzenesulfonates, alkylnaphthalenes, alkylsulfates, alkylphosphates, N-acyl-N-alkyltaurines, sulfosuccinates, sulfoalkylpolyoxyethylene alkyl phenyl ethers, polyoxyethylene alkylphosphates, and so on; amphoteric surface active agents of the amino acid type, the aminoalkylsulfonic acid type, the aminoalkyl sulfates or phosphates, the alkylbetaine type, the amine oxide type, and so on; and cationic surface active agents such as alkylamines, aliphatic or aromatic quaternary ammonium salts, heterocyclic quaternary ammonium salts such as pyridinium, imidazolium, etc., phosphoniums or sulfoniums containing aliphatic or heterocyclic rings, and so on.

The photographic emulsions which can be employed in the present invention can contain color image-forming couplers, i.e., compounds capable of forming dyes by reaction with oxidation products of aromatic amine (in general, primary amine) developing agents (generally referred to as "couplers"). It is desirable for the couplers to have a hydrophobic group called a ballast group in a molecule, by which they are rendered non-diffusible. The couplers may be either four equivalent or two equivalent to silver ion. The couplers may also include colored couplers having a color correction effect, and couplers capable of releasing development inhibitors with the progress of development (i.e., so-called DIR couplers). Further, the couplers may be those producing colorless compounds by the coupling reaction.

Known open-chain ketomethylene type couplers can be employed as yellow couplers. Of these couplers, compounds of the benzoylacetoanilide type and the pivaloylacetoanilide type are preferably used.

Pyrazolone compounds, indazolone compounds, cyanoacetyl compounds and so on can be employed as magenta couplers. In particular, pyrazolone compounds are used to advantage.

Phenol and naphthol derivatives can be employed as cyan couplers.

Besides DIR couplers, other compounds which can release development inhibitors with the progress of development may also be incorporated in the photographic material Specific examples of such compounds which can be used are described in U.S. Pat. Nos. 3,297,445 and 3,379,529, and West German Patent Application (OLS) No. 2,417,914.

Two or more of the above-described couplers can be incorporated into the same layer, or the same compound can also be incorporated into two or more different layers.

These couplers can be introduced into silver halide emulsion layers using known methods, e.g., the method described in U.S. Pat. No. 2,322,027, and so on.

In the photographic material of the present invention, silver halide emulsion layers may be provided on not only one side of a support but also the other side thereof.

A protective layer to be provided in the silver halide photographic material of the present invention is a layer made up of a hydrophilic colloid. Hydrophilic colloids described hereinbefore can be used for this purpose. The protective layer may be either a single layer or a double layer.

A matting agent and/or a smoothing agent may be added to the emulsion layers or the protective layer, preferably the protective layer, of the silver halide photographic material of the present invention. Suitable matting agents are particles having a proper size (ranging from 0.3 μm to 5 μm, or larger than a thickness of the protective layer by a factor of 2 or more, and preferably 4 or more) which may be made up of an organic compound such as a water dispersible vinyl polymer like polymethylmethacrylate, or an inorganic compound such as silver halide, strontium-barium sulfate, etc. Besides playing a part in prevention of adhesion problems, in analogy with matting agents, smoothing agents are effective for improvement in abrasion characteristics which concern the camera fitness of motion picture films at the time of picture-taking or projection. Suitable examples of smoothing agents which can be used include liquid paraffin, waxes like higher fatty acid esters, polyfluorinated hydrocarbons and the derivatives thereof, silicones such as polyalkylpolysiloxane, polyarylpolysiloxane, polyalkylarylpolysiloxane, and alkyleneoxide adducts of these polysiloxanes, and so on.

The silver halide photographic material of the present invention can optionally be provided with an antihalation layer, an interlayer, a filter layer and so on.

The silver halide photographic emulsions of the present invention can be employed for producing, e.g., X-ray sensitive materials, lithographic materials, black-and-white photographic materials for picture-taking, color negative photographic materials, color reversal photographic materials, color photographic printing paper, and so on.

In addition, various kinds of additives can be added to the photographic material of the present invention, if desired. For examples, dyes, hardeners, brightening agents, color fog-preventing agents, ultraviolet light-absorbing agents, and so on can be added. Specific examples these agents are described, e.g., in *Research Disclosure,* Vol. 176, pp. 28–30 (RD-17643, 1978).

The photographic emulsions of the present invention are coated on a flexible support, such as a plastic film, paper, cloth, etc., or a rigid support, such as glass, ceramic, metal, etc., using a dip coating process, a roller coating process, a curtain coating process, an extrusion coating process or so on. Useful flexible supports include films made up of semisynthetic or synthetic high polymers such as cellulose nitrate, cellulose acetate, cellulose acetate butyrate, polystyrene, polyvinyl chloride, polyethylene terephthalate, polycarbonate, etc.; paper coated or laminated with a baryta layer, an o-olefin polymer (e.g., polyethylene, polypropylene, or ethylene/butene copolymer), etc.; and so on.

Any known processing method and any known processing solution can be employed in the photographic processing of the photographic material produced in accordance with the embodiment of the present invention. The processing temperature is generally in the range of from about 18° C. to about 50° C. Of course, temperatures higher than about 50° C. or lower than about 18° C. may also be employed. The photographic processing in the present invention may be either a photographic processing for forming a silver image (black-and-white photographic processing) or a photographic processing for forming a dye image (color photographic processing), depending upon the end-use purpose of the photographic material.

The developing solution employed for black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid and so on, and these can be used alone or in combination. The developing solution can generally contain, in addition to the above-described developing agents, known preservatives, alkali agents, pH buffuring agents, antifoggants (e.g., methylbenzotriazole, nitroindazole, etc.) and so on. Optionally, it may further contain dissolving aids, color toning agents, development accelerators, surface active agents, defoaming agents, water softeners, hardeners, viscosity imparting agents and so on.

A suitable pH of the developing solution generally ranges from 9 to 11, and preferably is from 9.5 to 10.5.

In a preferred embodiment of the photographic processing, the photographic material using the photographic emulsions of the present invention is processed with a processing solution (e.g., a developing bath, the pre-bath thereof, etc.) containing a dialkylaldehyde series hardener (e.g., glutaraldehyde, β-methylglutarladehyde, succinic dialdehyde, etc.) in an amount of from about 1 g to about 20 g per 1 liter thereof. The processing described above is particularly effective in diminishing the processing dependence, e.g., development temperature dependence, of the photographic emulsions of the present invention.

Fixing solutions having generally used compositions can be employed in the present invention.

Suitable fixing agents which can be used include not only thiosulfates and thiocyanates, but also organic sulfur compounds which are known to be effective as fixing agents.

The fixing solutions may also contain water-soluble aluminium salts as hardeners.

Color images can be formed using conventional methods. For instance, a negative-positive process (as described in *Journal of the Society of Motion Picture and Television Engineers,* vol. 61, pp. 667-701 (1953); and so on), a color reversal process in which a negative silver image is formed by development with a developing solution containing a black-and-white developing agent, uniform exposure or another appropriate fogging treatment is carried out at least once, and subsequently, color development is carried out to provide a positive dye image; a silver dye bleach process in which dye-containing photographic emulsion layers are developed after exposure to produce a silver image, and the dyes are bleached using the resulting silver image as a bleaching catalyst; and so on can be employed.

A color developing solution is, in general, an alkaline aqueous solution containing a color developing agent. Suitable examples of color developing agents which can be used include known aromatic primary amine developers, such as phenylene diamines (e.g., 4-amino-N,N-diethylaniline, 3-methyl-4-amino-N,N-diethylaniline, 4-amino-N-ethyl-N-βhydroxyethylaniline, 3-methyl-4-amino-N-ethyl-N-8-hydroxyethylaniline, 3-methyl-4-amino-N-ethyl-N-8-methanesulfonamidoethylaniline, 4-amino-3-methyl-N-ethyl-N-8-methoxyethylaniline, etc.).

In addition to the above-described color developing agents, those described in L.F.A. Mason, *Photographic Processing Chemistry,* pp. 226–229, Focal Press, London (1966), U.S. Pat. Nos. 2,193,015 and 2,592,364, Japanese Patent Application (OPI) No. 64933/73, and so on may also be employed.

The color developing solution can additionally contain pH buffering agents such as sulfites, carboxylates, borates and phosphates of alkali metals; development inhibitors or antifoggants, such as bromides, iodides and organic antifoggants; and so on. Further, it may optionally contain water softeners, preservatives like hydroxyamine, organic solvents such as benzyl alcohol and diethylene glycol, development accelerators such as polyethylene glycol, quaternary ammonium salts and amines, dye-forming couplers, competing couplers, fogging agents like sodium borohydride, auxiliary developers like 1-phenyl-3-pyrazolidone, viscosity-imparting agents, and so on.

The photographic emulsion layers which have been color development-processed are generally subjected to a bleach-processing. The bleach-processing may be carried out either simultaneously with or separately from a fix-processing. Suitable examples of bleaching agents which can be used include compounds of polyvalent metals such as Fe(III), Co(IV), Cr(VI), Cu(II), etc., peroxy acids, quinones, nitroso compounds and so on. For example, fericyanides; dichromates; organic complexes of Fe(III) or Co(III), such as complex salts of organic acids (e.g., aminopolycarboxylic acids such as ethylenediamine tetraacetic acid, nitrilotriacetic acid, 1,3-diamino-2-propanol tetraacetic acid, etc., complexes of organic acids such as citric acid, tartaric acid, malic acid, and so on); persulfate and permanganate; nitrosophenol; and so on can be employed. Of these cbmpounds, potassium ferricyanide, sodium ethylenediaminetetraacetatoferrate (III) and ammonium ethylenediaminetetraacetatoferrate (III) are particularly useful. (Ethylenediaminetetraacetato)iron (III) complexes are useful in both independent bleaching solution and in a combined bleaching and fixing (blix) solution.

Not only can bleach accelerators as described, e.g., in U.S. Pat. Nos. 3,042,520 and 3,241,966, Japanese Patent Publication Nos. 8506/70 and 8836/70 be added to a bleaching or blix solution, and but so can various other kinds of additives. For details of the above-described additives and the processing method descriptions, see in *Research Disclosure,* Vol. 176 (RD-17643, 1978) in addition to those in the above-described patent specifications can be referred to.

The present invention is illustrated in greater detail by reference to the following examples. However, the invention is not intended to be construed as being limited to these examples.

EXAMPLE 1

Silver iodobromide grains (silver iodide content: 1.5 mol%) were formed in the presence of ammonia using a double jet method. The mean grain size of the thus formed grains was 1.35 μm and the distribution density of silver iodide in the grains was homogeneous throughout. This emulsion was washed with water in a conventional manner, whereby unnecessary salts were removed. Thereafter, the emulsion was divided into five equal fractions. The pH value and pAg value of each fraction were controlled to optimum values, and the fractions were so ripened chemically as described below.

(1) Chemical ripening was carried out using sodium thiosulfate (pentahydrate) and potassium chloroaurate (Control fraction).

(2) 4-Hydroxy-6-methyl-1,3,3a,7-tetraazaindene (V-1) was added to the emulsion, and the resulting emulsion was chemically ripened using sodium thiosulfate (pentahydrate) and potassium chloroaurate.

(3) 4-Hydroxy-6-methyl-1,3,3a,7-tetraazaindene (V-1) was added, and the resulting emulsion was chemically ripened using sodium thiosulfate (pentahydrate), 4,7-dithia-1,10-decanedion (II-2) and potassium chloroaurate.

(4) Hydroxy-6-methyl-1,3,3a,7-tetraazaindene (V-1) was added, and the resulting emulsion was chemically ripened using sodium thiosulfate (pentahydrate), organic thioether (II-1) and potassium chloroaurate.

(5) Chemical sensitization was carried out in the same manner as in (3) except that 4-(5-mercapto-1,3,4-thiadiazole2-ylthio)butanesulfonic acid sodium salt (Compound A) was used in place of 4,7-dithia-1,10-decanediol.

After the conclusion of chemical ripening, generally used photographic additives such as antifoggant (1-phenyl-1-mercaptotetrazole), stabilizer (4-hydroxy-6-methyl-1,3,7-tetraazaindene), coating aid (saponin) and so on were identically added to all fractions to prepare coating compositions for forming emulsion layers.

Each of said coating compositions for emulsion layers was coated together with a coating composition for forming a surface protecting layer, which was constituted with gelatin, a matting agent, saponin and a hardener (2,4-dichloro-6-hydroxy-s-triazine), on a polyethylene terephthalate film support provided with a subbing layer, and dried.

A silver coverage on one side of the support was 4 g/m$^2$. These samples were subjected to sensitometry in the following manner.

Exposure was carried out using a tungsten lamp as a light source and passing the light from this source through a filter having a transmission peak at 420 nm and an optical wedge. The exposure time used was 1/20 second. Development was carried out at 35° C for 25 seconds using X-ray developer RD III (produced by Fuji Photo Film Co., Ltd.) as a developing solution and a roller conveyor type auto processor RN (made by Fuji Photo Film Co., Ltd.). Thereafter, each sample was subjected to fixation, washing and drying steps, in that order, followed by sensitometry.

In Table 1, a standard point of the optical density used to determine the sensitivity was fog +0.3, and the standard sensitivity of the sample which had received the chemical ripening treatment (1) was set at 100.

Processing temperature dependence was expressed in terms of the difference between the reciprocals of exposures required for obtaining the density of fog +0.5 by development at 31° C. and 37° C. (temperature of the developing solution RD III).

Knick desensitization characteristics arising from the bending of samples before exposure were evaluated by classification into five grades. The smallest extent of desensitization caused in the pressed part was ranked as grade 5, and the largest one ranked as grade 1.

Pressure was applied to samples by bending them along a curved surface having a radius of curvature of 4 mm and thereafter, exposure and subsequent development were carried out under the above-described conditions. No desensitization was represented by the grade 5.

A safelight filter aptitude was expressed in terms of the reciprocal of exposure required for obtaining the density of fog +0.5 when the sample was exposed to light, which had passed through a commercially available Fuji Safelight Filter 8U, through an optical wedge. Therein, the results obtained were represented as relative values with respect to the sample (1) as 100. The aptitude for the safelight filter is better as this value is lower.

The results of the evaluations are shown in Table 1.

TABLE 1

| | Compound added | | | Sensitivity | Processing | Pressure Desensitization | |
|---|---|---|---|---|---|---|---|
| Sample No. | V - 1 (mg/mol Ag) | Compound (mg/mol Ag) | Comparative Compound (mg/mol Ag) | to Blue Light (relative value) | Temperature Dependence (Δ log E) | before Exposure | Safelight Aptitude |
| (1) Control | — | — | — | 100 | 0.40 | 3 | 100 |
| (2) | 34 | — | — | 115 | 0.30 | 1 | 120 |
| (3) Invention | 34 | II-2 20 | — | 115 | 0.30 | 4 | 60 |
| (4) Invention | 34 | II-1 50 | — | 115 | 0.30 | 3 | 60 |
| (5) | 34 | — | Compound A | 100 | 0.40 | 3 | 100 |

TABLE 1-continued

| Sample No. | Compound added V - 1 (mg/mol Ag) | Compound (mg/mol Ag) | Comparative Compound (mg/mol Ag) | Sensitivity to Blue Light (relative value) | Processing Temperature Dependence (Δ log E) | Pressure Desensitization before Exposure | Safelight Aptitude |
|---|---|---|---|---|---|---|---|
| | | | 60 | | | | |

As can be seen from the results of Table 1, the merits of using a nitrogen-containing heterocyclic compound (which was 4-hydroxy-6-methyl-1,3,3a,7-tetraazaindene (V-1) in this example) at the time of chemical ripening are to make improvement in processing dependence and to increase the sensitivity of silver halide to light of wavelengths in the vicinity of 420 nm±30 nm (blue light), while its demerits are to cause pressure desensitization and deterioration of an aptitude for safelight, and in the samples of the present invention the above-described demerits are greatly diminished by the combined use with an organic thioether compound (which was II-1 or II-2 in this example) as the above-described merits are retained.

The effect described above was unable to be obtained by the combined use with a different compound (Compound A). On the contrary, decrease in sensitivity to blue light and deterioration of processing temperature dependence were caused by the combined use with Compound A.

(9) Chemical ripening was carried out using 4-hydroxy-6-methyl-1,3,3a,7-tetraazaindene (V-1), sodium thiosulfate (pentahydrate), 4,7,10-trithiatridecane-1,2,12,13-tetraol (II-14) and potassium chloroaurate.

(10) Chemical ripening was carried out using 4-hydroxy-6-methyl-1,3,3a,7-tetraazaindene (V-1), sodium thiosulfate (pentahydrate), thiourea (Compound B) and potassium chloroaurate.

After the conclusion of chemical ripening, generally used photographic additives such as an anti-foggant, a stabilizer, a coating aid and so on were added to all fractions to prepare coating compositions for forming emulsion layers.

Each of said coating compositions was coated on a support in the same manner as in Example 1, and dried.

Evaluations of sensitivity, processing temperature dependence, pressure desensitization and safelight aptitude were carried out using the same methods as in Example 1, respectively.

The results obtained are shown in Table 2.

TABLE 2

| Sample No. | Compound added V - 1 (mg/mol Ag) | Compound (mg/mol Ag) | Comparative Compound (mg/mol Ag) | Sensitivity to Blue Light (relative value) | Processing Temperature Dependence (Δ log E) | Pressure Desensitization before Exposure | Safelight Aptitude |
|---|---|---|---|---|---|---|---|
| (6) Control | — | — | — | 100 | 0.35 | 3 | 100 |
| (7) | 60 | — | — | 120 | 0.28 | 1 | 110 |
| (8) Invention | 60 | I-1 15 | — | 120 | 0.28 | 4 | 55 |
| (9) Invention | 60 | II-14 40 | — | 120 | 0.28 | 4 | 60 |
| (10) | 60 | — | Compound B 20 | 100 | 0.35 | 1 | 110 |

EXAMPLE 2

Silver iodobromide grains (silver iodide content: 2.5 mol%) were formed in the presence of ammonia using a double jet process. The mean grain size of the thus formed grains was 1.0 μm, and the distribution density of silver iodide was higher at the interior of the grains than at the surface thereof. This emulsion was washed with water in conventional manner and thereby, unnecessary salts were removed. Then, the emulsion was divided into five fractions having the same volume. The pH value and a pAg value of each fraction were adjusted to optimum values in a conventional manner respectively, and the resulting fractions were so ripened chemically as described below.

(6) Chemical ripening was carried out using sodium thiosulfate (pentahydrate) and potassium chloroaurate (control sample).

(7) Chemical ripening was carried out using 4-hydroxy-6-methyl-1,3,3a,7-tetraazaindene (V-1), sodium thiosulfate (pentahydrate) and potassium chloroaurate.

(8) Chemical ripening was carried out using 4-hydroxy-6-methyl-1,3,3a.7-,tetraazaindene (V-1), sodium thiosulfate (pentahydrate), N,N'-tetramethylthiourea (I-1) and potassium chloroaurate.

As can be seen clearly from the results in Table 2, the effect of the present invention can also be produced by carrying out chemical sensitization using a combination of the tetrasubstituted thiourea (I-1) or the organic thioether compound (II-14) with 4-hydroxy-6-methyl,3-,3a,7-tetraazaindene.

On the contrary, far from achieving improvements in pressure desensitization and safelight aptitude, the combined use with the comparative compound B brought about a decrease in sensitivity to blue light and deterioration with respect to processing temperature dependence.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide photographic material, comprising subjecting a silver halide photographic emulsion comprising silver iodochlorobromide or silver iodochlorobromide grains to sulfur sensitization or gold-sulfur sensitization in the presence of (1) at least one of an organic thioether compound and a tetra-substituted thiourea and (2) 1 mg to $1\times10^3$ mg per mol of silver halide of a nitrogen-containing heterocyclic compound selected from the compounds represented by formulae (V) and (VI), the amount in combination of said (1) at least one of an organic thioether compound and a tetra-substituted thiourea and (2) a nitrogen-containing heterocyclic compound being sufficient to improve pressure desensitization and safelight aptitude of said silver halide photographic material, and adding a stabilization effective amount of a nitrogen-containing heterocyclic compound selected from the compounds represented by formulae (V) and (VI) to said silver halide photographic emulsion after chemical ripening but prior to coating of said emulsion:

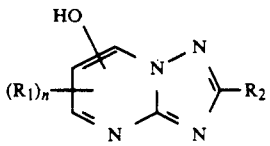

(V)

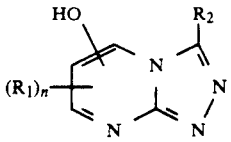

(VI)

wherein $R_1$ and $R_2$, which may be the same or different, each represents a hydrogen atom; an alkyl group; an alkyl group substituted by an aromatic residue; an alkyl group substituted by an alkoxy group; an alkyl group substituted by a hydroxy group, a carbonyl group or an alkoxycarbonyl group; an aryl group; or an aryl group having a substituent group, and n represents 1 or 2.

2. A method as in claim 1, wherein the silver halide photographic emulsion is subjected to sulfur sensitization or gold-sulfur sensitization in the presence of (1) an organic thioether compound and (2) a nitrogen containing heterocyclic compound.

3. A method as in claim 1, wherein the silver halide photographic emulsion is subjected to sulfur sensitization or gold-sulfur sensitization in the presence of (1) a tetrasubstituted thiourea compound and (2) a nitrogen-containing heterocyclic compound.

4. A method as in claim 1, wherein the tetrasubstituted thiourea is represented by formula (I)

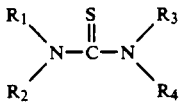

(I)

wherein $R_1$, $R_2$, $R_3$, and $R_4$, which may be the same or different from one another, each represents a substituted or unsubstituted alkyl group, an alkenyl group, or a substituted or unsubstituted aryl group, or $R_1$ and $R_2$, $R_2$ and $R_3$, or $R_3$ and $R_4$ can combine with each other to form a 5- or 6-membered heterocyclic ring, and the total number of carbon atoms contained in $R_1$, $R_2$, $R_3$, and $R_4$ is 30 or less.

5. A method as in claim 4, wherein three or more of substituents $R_1$ to $R_4$ are alkyl groups, each containing from 1 to 5 carbon atoms, and the total number of carbon atoms contained in. $R_1$ to $R_4$ is 20 or less.

6. A method as in claim 1, wherein the amount of tetrasubstituted thiourea present is from 1 mg to 10 g per mole of silver halide present in the silver halide emulsion.

7. A method as in claim 1, wherein said organic thioether compound is represented by formulae (II), (III), or (IV)

$$R_1-(X-R_3)_m-X-R_2 \quad \text{(II)}$$

wherein $R_1$ and $R_2$ each represents a substituted alkyl group containing from 1 to 5 carbon atoms; $R_3$ represents an alkylene group containing from 1 to 4 carbon atoms; $R_4$ represents a hydrogen atom, or an alkyl group containing from 1 to 5 carbon atoms; X represents a sulfur atom or an oxygen atom, and at least one X within $-(X-R_3)_m-$must be a sulfur atom; m represents 0 or an integer of 1 to 4; and M represents an alkali metal atom; and $$Q-[(CH_2)_r-CH_2-S-(CH_2)_2-X-(R)_p-(CH_2)_2-(R')_q-S-CH_2(CH_2)_m-Z]_n \quad \text{(III)}$$

$$Q-(CH_2)_m-CH_2-S-(CH_2)_n-S-CH_2-(CH_2)_r-Z \quad \text{(IV)}$$

wherein r and m each represents 0 or an integer of from 1 to 4; n represents an integer of 1 to 4; p and q each represents 0 or an integer of 1 to 3; X represents an oxygen atom, a sulfur atom, $$-\overset{O}{\overset{\|}{C}}NH-,\ -\overset{O}{\overset{\|}{C}}-\ \text{or}\ -\overset{O}{\overset{\|}{C}}-O-;$$

R and R' each represents an ethylene oxide group; and Q and Z each represents —OR'', $$-\overset{O}{\overset{\|}{C}}-OR''$$

(wherein R'' represents a hydrogen atom or an alkyl group containing from 1 to 5 carbon atoms), $$-\overset{O}{\overset{\|}{C}}NH_2,$$

or Q and Z can represent substituents set forth as X and combine with each other to form a cyclized compound.

8. A method as in claim 7, wherein the organic thioether compound is selected from among those represented by formula (III) or (IV) which are represented by one of formulae (A), (B), (C), (D), (E), and (F)

$$HO-R^2-(S-R^4)_n-S-R^2-OH \quad \text{(A)}$$

$$(HO-R^2-S-R^2-O-R^4-)_2 \quad \text{(B)}$$

$$(R^3-O-R^2-S-R^2-\overset{O}{\overset{\|}{C}}-NH-R^4-)_2 \quad \text{(C)}$$

$$(R^2-O-R^2-S-R^2-)_2S \quad \text{(D)}$$

$$(R^3-NH-\overset{O}{\overset{\|}{C}}-R^2-S-R^2-)_2O \quad \text{(E)}$$

-continued

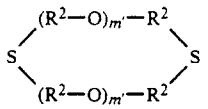

(F)

wherein r' is 0 or an integer of 1 to 3, m' is 1 or 2, $R^2$ and $R^4$ each is a methylene group or an alkylene group containing from 1 to 5 carbon atoms, and $R^3$ is an alkyl group containing from 1 to 5 carbon atoms.

9. A method as in claim 1, wherein organic thioether is present in an amount of from 1 mg to 10 g per mole of silver halide in the silver halide photographic emulsion.

10. A method as in claim 1, wherein said sulfur or gold-sulfur sensitization is carried out under conditions of a pH of from 5 to 8 and a pAg of from 8 to 10.

11. A method as in claim 1, wherein said silver halide emulsion comprises silver iodochlorobromide grains in which the halide composition is not more than 10 mole percent silver chloride.

12. A method as in claim 1, wherein the silver iodide distribution in the silver halide grains contained in said silver halide emulsion is homogeneous throughout the grains or the silver iodide content is higher in the internal portion than in the surface portion of the silver halide grains.

13. A method as in claim 1, wherein said at least one of an organic thioether compound and a tetrasubstituted thiourea and said nitrogen-containing heterocyclic compound are added following washing and prior to chemical ripening.

14. A method as in claim 1, wherein said iodobromide or silver iodochlorobromide grains have a silver iodide content of 5 mole percent or less.

15. A silver halide photographic material having a silver halide photographic emulsion comprising silver iodobromide or silver iodochlorobromide grains which has been sulfur sensitized or gold-sulfur sensitized in the presence of (1) at least one of an organic thioether compound and a tetra-substituted thiourea and (2) 1 mg to $1\times10^3$ mg per mol of silver halide or a nitrogen-containing heterocyclic compound selected from the compounds represented by formulae (V) and (VI), the amount in combination of said (1) at least one of an organic thioether compound and a tetra-substituted heterocyclic compound being sufficient to improve pressure desensitization and safelight aptitude of said silver halide photographic material, and to which silver halide photographic emulsion a stabilization effective amount of a nitrogen-containing heterocyclic compound selected from the compounds represented by formulae (V) and (VI) has been added after chemical ripening but prior to coating of said emulsion;

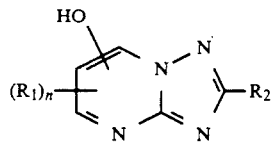

(V)

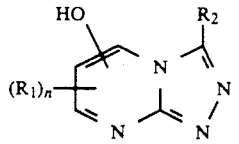

(VI)

wherein $R_1$ and $R_2$, which may be the same or different, each represents a hydrogen atom; an alkyl group; an alkyl group substituted by an aromatic residue; an alkyl group substituted by an alkoxy group; and alkyl group substituted by a hydroxy group, a carbonyl group or an alkoxycarbonyl group; an aryl group; or an aryl group having a substituent group, and n represents 1 or 2.

16. A silver halide photographic material as in claim 13, having a silver halide photographic emulsion which has been sulfur sensitized or gold-sulfur sensitized in the presence of (1) an organic thioether compound and (2) a nitrogen-containing heterocyclic compound.

17. A silver halide photographic material as in claim 13, having a silver halide photographic emulsion which has been sulfur sensitized or gold-sulfur sensitized in the presence of (1) a tetrasubstituted thiourea and (2) a nitrogen-containing heterocyclic compound.

18. A silver halide photographic material as claimed in claim 13, wherein said silver halide photographic emulsion has had said of at least of an organic thioether compound or tetrasubstituted thiourea and said nitrogen-containing heterocyclic compound added following washing and prior to chemical ripening.

19. A silver halide photographic material as in claim 13, wherein said silver iodobromide or silver iodochlorobromide grains have a silver iodide content of 5 mole percent or less.

* * * * *